US008781743B2

(12) United States Patent
McKay et al.

(10) Patent No.: US 8,781,743 B2
(45) Date of Patent: Jul. 15, 2014

(54) MONITORING THE HEALTH OF A BLOWOUT PREVENTER

(75) Inventors: James Edwin McKay, Houston, TX (US); Gavin Triscott Starling, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 402 days.

(21) Appl. No.: 13/285,689

(22) Filed: Oct. 31, 2011

(65) Prior Publication Data

US 2012/0197527 A1 Aug. 2, 2012

Related U.S. Application Data

(60) Provisional application No. 61/436,731, filed on Jan. 27, 2011.

(51) Int. Cl.

| | |
|---|---|
| ***G06F 19/00*** | (2011.01) |
| ***E21B 34/04*** | (2006.01) |
| ***E21B 41/00*** | (2006.01) |
| ***E21B 33/064*** | (2006.01) |

(52) U.S. Cl.

CPC ..... *E21B 41/0007* (2013.01); *E21B 33/064* (2013.01)

USPC ..... 702/6; 175/25; 702/9; 702/12

(58) Field of Classification Search

CPC ... E21B 21/08; E21B 33/064; E21B 41/0007; E21B 33/0355; E21B 33/06

USPC ..... 702/6, 34, 47, 51, 55, 64, 114, 116, 702/123, 130, 9, 12; 166/336, 341; 175/5, 175/25, 57, 24; 348/143; 700/282

See application file for complete search history.

(56) References Cited

U.S. PATENT DOCUMENTS

| | | | | |
|---|---|---|---|---|
| 6,484,816 | B1 * | 11/2002 | Koederitz | 175/25 |
| 2002/0060093 | A1 | 5/2002 | Womer et al. | |
| 2009/0236144 | A1 * | 9/2009 | Todd et al. | 175/5 |

FOREIGN PATENT DOCUMENTS

EP 1227215 A2 7/2002

OTHER PUBLICATIONS

PCT International Search Report issued in International Application No. PCT/US2011/059957, mailed Mar. 25, 2013, 12 pages.

F.M. Chapman et al.: Deepwater BOP Control Monitoring—Improving BOP Preventive Maintenance With Control Function Monitoring OTC 20059, Offshore Technology Conference, May 4, 2009, pp. 1-8, XP55056528, Houston, USA.

(Continued)

*Primary Examiner* — John H Le

(74) *Attorney, Agent, or Firm* — Barbara Fisher

(57) ABSTRACT

A computerized monitoring system and corresponding method of monitoring the status and health of a blowout preventer. The system includes a graphics display at which a graphical user interface (GUI) displays the health of various sealing elements and control systems by way of "traffic light" indicators. The health indicators are evaluated, by the monitoring system, based on a risk profile for each of the indicated elements and control systems. The risk profiles are evaluated based on inputs such as measurement inputs, feedback signals, mechanical positions, diagnostic results, drilling conditions, and other status information of the blowout preventer at a given time and based on levels of redundancy and levels of deviation from normal conditions. The GUI includes recent history of changes in operating condition, and alarm indications such as poor health, along with the times of those events.

31 Claims, 8 Drawing Sheets

(56) References Cited

OTHER PUBLICATIONS

Eldon Ball, "GE Oil and Gas Continues Aquisition, Expansion Strategy," Offshore Magazine, vol. 71, Issue 8, 2011, 4 pages.
Author Unknown, Barracuda BOP (Blow Out Prevention) Zone 2 Industrial Computer, http://www.azonix.com/rugged-computer-products/hazardous_area_displays/barracuda-bop-hazardous-area-computer.html, Retrieved Apr. 11, 2012, 2 pages.
Author Unknown, GE Oil & Gas Corporate Video, You Tube Video, http://www.youtube.com/watch?v=4xL0N0VQIEk, Oct. 25, 2010, 1 page.

* cited by examiner

| | HPU ANALYSIS | POTABLE WATER ANALYSIS | FLOW ANALYSIS |
|---|---|---|---|
| NO LEAK | 0 | 0 | 0 |
| SURFACE LEAK | 1 | 0 | 0 |
| SUBSEA LEAK | 1 | 1 | 0 |
| SUBSEA LEAK | 1 | 1 | 1 |
| SUBSEA LEAK | 1 | 0 | 1 |

MONITORING THE HEALTH OF A BLOWOUT PREVENTER

CROSS-REFERENCE TO RELATED APPLICATIONS

This application claims priority to U.S. Provisional Application No. 61/436,731 filed Jan. 27, 2011, the disclosure of which is incorporated herein in its entirety.

FIELD

This disclosure relates generally to hydrocarbon production. Embodiments of this disclosure are more specifically directed to the operation of well control devices such as blowout preventers.

DESCRIPTION OF THE RELATED ART

As known in the art, the penetration of high-pressure reservoirs and formations during the drilling of an oil and gas well can cause a sudden pressure increase ("kick") in the wellbore itself. A significantly large pressure kick can result in a "blowout" of drill pipe, casing, drilling mud, and hydrocarbons from the wellbore, which can result in failure of the well.

Blowout preventers ("BOPs") are commonly used in the drilling and completion of oil and gas wells to protect drilling and operational personnel, and the well site and its equipment, from the effects of a blowout. In a general sense, a blowout preventer is a remotely controlled valve or set of valves that can close off the wellbore in the event of an unanticipated increase in well pressure. Modern blowout preventers typically include several valves arranged in a "stack" surrounding the drill string. The valves within a given stack typically differ from one another in their manner of operation, and in their pressure rating, thus providing varying degrees of well control. Many BOPs include a valve of a "blind shear ram" type, which can serve to sever and crimp the drill string, serving as the ultimate emergency protection against a blowout if the other valves in the stack cannot control the well pressure.

In modern deep-drilling wells, particularly in offshore production, the control systems involved with conventional blowout preventers have become quite complex. As known in the art, the individual valves in blowout preventers can be controlled both hydraulically and also electrically. In addition, some modern blowout preventers can be actuated by remote operated vehicles (ROVs), should the internal electrical and hydraulic control systems become inoperable. Typically, some level of redundancy for the control systems in modern blowout preventers is provided.

Given the importance of blowout preventers in present-day drilling operations, especially in deep offshore environments, it is important for the well operator to have confidence that a deployed blowout preventer is functional and operable. As a result, the well operator will regularly functionally test the blowout preventer, such tests including periodic functional tests of each valve, periodic pressure tests of each valve to ensure that the valves seal at specified pressures, periodic actuation of valves by an ROV, and the like. Such tests may also be required by regulatory agencies, considering the danger to human and environmental safety presented by well blowouts. Of course, such periodic tests consume personnel and equipment resources, and can require shutdown of the drilling operation.

In addition to these periodic tests, the functionality and health of modern blowout preventers can be monitored during drilling, based on feedback signals in the blowout preventer control systems and solenoid control valves, on diagnostics executed by the control system itself, and indirectly from downhole pressure measurements and the like. However, in conventional blowout preventer control systems, these various inputs and measurements generate a large amount of data over time, with some data providing relatively indirect measures of the functionality of the particular element (e.g., measurement of the number of gallons of hydraulic fluid required to hydraulically close a particular sealing element). In addition, given the disparate data sources and the large amount of data, the harsh downhole environment in which the blowout preventer is deployed, and the overwhelming cost in resources and downtime required to perform maintenance and replacement of blowout preventer components, off-site expert personnel such as subsea engineers are assigned the responsibility of determining blowout preventer functional status. This analysis is generally time-consuming and often involves the subjective judgment of the analyst. Drilling personnel at the well site often are not able to readily determine the operational status or "health" of blowout preventers, much less in a timely and comprehensible manner.

SUMMARY

A computerized monitoring system and corresponding method of monitoring the status and health of a blowout preventer. The system includes a graphics display, for example as deployed at the drilling site and viewable by on-site personnel, at which a graphical user interface (GUI) displays the health of various sealing elements and control systems by way of "traffic light" indicators. The health indicators are evaluated, by the monitoring system, based on a risk profile for each of the indicated elements and control systems. The risk profiles are evaluated based on inputs such as measurement inputs, feedback signals, mechanical positions, diagnostic results, drilling conditions, and other status information of the blowout preventer at a given time and based on levels of redundancy and levels of deviation from normal conditions. The GUI also includes recent history of changes in operating condition, and alarm indications such as poor health, along with the times of those events.

BRIEF DESCRIPTION OF THE DRAWINGS

Various features of the embodiments can be more fully appreciated, as the same become better understood with reference to the following detailed description of the embodiments when considered in connection with the accompanying figures, in which.

DETAILED DESCRIPTION

For simplicity and illustrative purposes, the principles of the present teachings are described by referring mainly to exemplary embodiments thereof, namely as implemented into a computerized monitoring system for determining the health and status of a blowout preventer in an offshore drilling context. However, it is of course contemplated that this disclosure can be readily applied to and provide benefit in to other drilling and production applications beyond that described in this disclosure, including blowout preventers deployed at the surface. One of ordinary skill in the art would readily recognize that the same principles are equally applicable to, and can be implemented in, all types of information and systems, and that any such variations do not depart from the true spirit and scope of the present teachings. Moreover, in the following detailed description, references are made to the accompanying figures, which illustrate specific exemplary embodiments. Electrical, mechanical, logical and structural changes may be made to the exemplary embodiments without departing from the spirit and scope of the present teachings. The following detailed description is, therefore, not to be taken in a limiting sense and the scope of the present teachings is defined by the appended claims and their equivalents.

Figure 1:
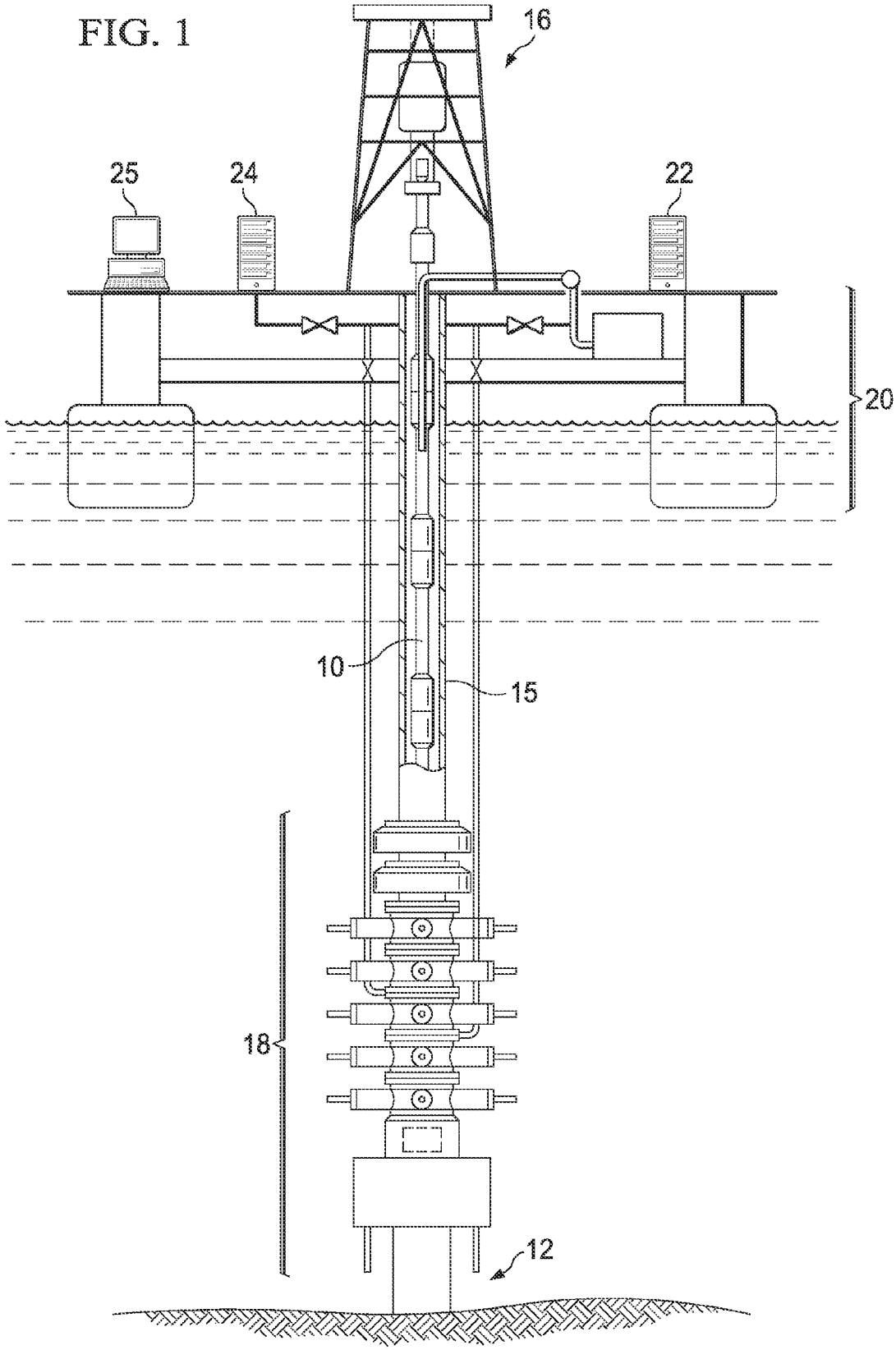
FIG. 1 is an elevation and cross-sectional view of a drilling site including the drill string, blowout preventer stack, and a monitoring system according to embodiments of this disclosure.

FIG. 1 illustrates a generalized example of the basic components involved in drilling an oil and gas well in an offshore environment, to provide context for this description. While FIG. 1 illustrates various components, one skilled in the art will realize that FIG. 1 is exemplary and that additional components can be added and existing components can be removed.

In this example, a drilling rig 16 can be supported at an offshore platform 20, and can be supporting and driving drill pipe 10 within a riser 15. A blowout preventer ("BOP") stack 18 can be supported by a wellhead 12, which itself is located at or near the seafloor; the BOP stack 18 can also be connected to the riser 15, through which the drill pipe 10 travels. A drilling control computer 22 can be a computer system that controls various functions at the drilling rig 16, including the drilling operation itself along with the circulation and control of the drilling mud. A BOP control computer 24 can be a computer system that controls the operation of the BOP stack 18. Both of the drilling control computer 22 and the BOP control computer 24 can be deployed at the platform 20, in this example. Likewise, the functions of the drilling control computer 22 and the BOP control computer 24 can be performed by one or more programmable controller logic ("PLC") devices. In this context, a computerized monitoring system 25 can serve as the BOP monitoring system according to embodiments, and can be deployed at the platform 20 for operation and viewing by on-site personnel. As will be described in further detail below, the monitoring system 25 can be in communication with on-shore remote computing resources, which can assist in the monitoring and analysis functions of embodiments. Likewise, the monitoring system 25 can be located on-shore and can communicate with the systems of the drilling rig 16. The monitoring system 25 can receive various inputs from blowout preventer stack 18, from downhole sensors along the wellbore, from the drilling control computer 22, from the BOP control computer 24, and from both on-site and off-site personnel.

Figure 2:
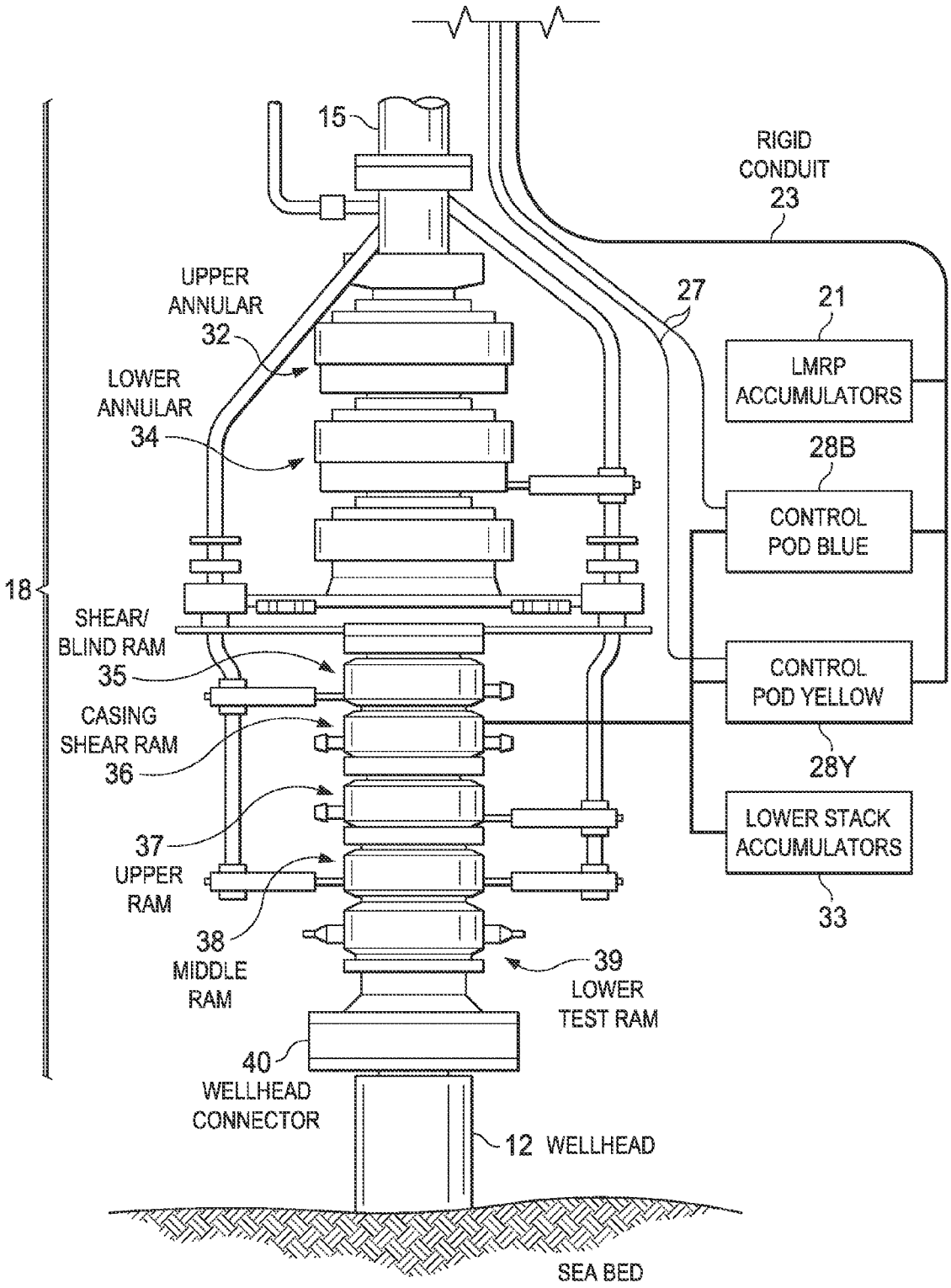
FIG. 2 is a cross-sectional view of an example of a blowout preventer stack in the drilling site of FIG. 1.

An example of the BOP stack 18 is shown in greater detail in FIG. 2. The BOP stack 18 typically can include multiple types of sealing elements, with the various elements typically having different pressure ratings, and often performing their sealing function in different ways from one another. Such redundancy in the sealing elements not only ensures reliable operation of the BOP stack 18 in preventing full failure, but also provides responsive well control functionality during non-emergency operation. Of course, the number and types of sealing members within the BOP stack 18 can vary from installation to installation, and from environment to environment. As such, while FIG. 2 illustrates various components included in the BOP stack 18, the BOP stack 18 illustrated in FIG. 2 is exemplary and additional components can be added and existing components can be removed.

In this example, as shown in FIG. 2, the BOP stack 18 can include a riser connector 31, which connects the BOP stack 18 to the riser 15 (illustrated in FIG. 1); on its opposite end, the BOP stack 18 can be connected to the wellhead 12 by way of a wellhead connector 40. From top to bottom, the sealing elements of this example of the BOP stack 18 can include an upper annular element 32, a lower annular element 34, a blind shear ram element 35, a casing shear ram element 36, an upper ram element 37, a middle ram element 38, and a lower test ram element 39. The function and operation of these annular and ram elements are well known in the blowout preventer art. The upper annular element 32 and the lower annular element 34, when actuated, can operate as bladder seals against the drill pipe 10, and because of their bladder-style construction can be useful with the drill pipe 10 of varying outside diameter and cross-sectional shape. The blind shear ram element 35, the casing shear ram element 36, the upper ram element 37, the middle ram element 38, and the lower test ram element 39 can include rubber or rubber-like sealing members of a given shape that press against the drill pipe 10 to perform the sealing function. The blind shear ram elements 35 and the casing shear ram element 36 can be actuated in the last resort, and operate to shear the drill pipe 10 and casing, respectively; the blind shear ram element 35 can be intended to also crimp the sheared the drill pipe 10. As mentioned above, these various elements typically have different pressure ratings, and thus provide a wide range of well control functions.

A blue control pod 28B and a yellow control pod 28Y are also shown in FIG. 2. Each of the blue control pod 28B and the yellow control pod 28Y can include the appropriate electronic and hydraulic control systems, by way of which the various sealing elements are controllably actuated and their positions sensed, as known in the art. MUX cables 27 can be connected to the blue control pod 28B and the yellow control pod 28Y to communicate with, provide control signals to, and provide power to the blue control pod 28B and the yellow control pod 28Y. The blue control pod 28B and the yellow control pod 28Y can be deployed a "lower marine riser package", or "LMRP", which can be connected to the bottom of the riser 15. The LMRP can also include LMRP accumulators 21 for a hydraulic system, the upper annular element 32 and the lower annular element 34. The hydraulic system can also include lower stack accumulators 33. As shown in FIG. 2, the hydraulic system can be in communication with the various elements of the BOP stack 18, and can include hydraulic lines, such as rigid conduit 23 and control valves that move the appropriate components of sealing elements to perform the desired function. Redundancy can be provided by the blue control pod 28B and the yellow control pod 28Y being constructed as duplicates of one another, with each capable of actuating each of the elements of the BOP stack 18 via the hydraulic system. In this example of the invention, the blue control pod 28B and the yellow control pod 28Y can receive operator inputs (e.g., from personnel at the platform 20), as well as feedback signals from control valves within the hydraulic system, and can include the appropriate electronic computing circuitry and output power drive circuitry to control solenoid valves in the hydraulic system to direct hydraulic fluid to the desired element, thus controlling the sealing elements of the BOP stack 18. This control functionality provided by the blue control pod 28B and the yellow control pod 28Y can be contemplated to be well-known by those skilled in the art. In addition, the BOP control computer 24 can include diagnostic capability by way of which the functionality of the blue control pod 28B and the yellow control pod 28Y can be analyzed, along with a communications link to the monitoring system 25 by way of which the results of those diagnostics are communicated.

Figure 3:
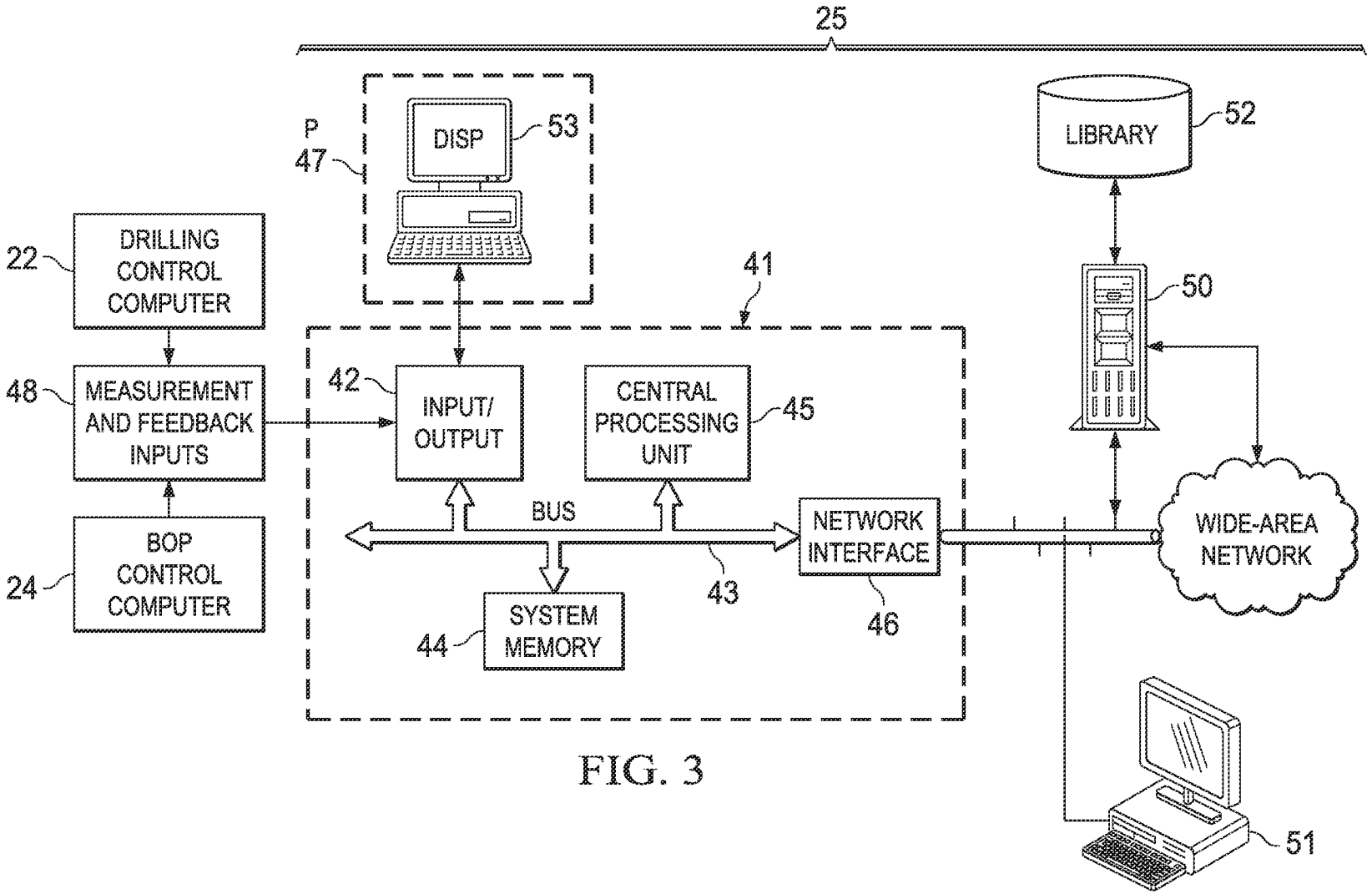
FIG. 3 is an electrical diagram, in block form, of a computerized monitoring system according to embodiments.

FIG. 3 illustrates an exemplary construction of the monitoring system 25 according to embodiments, which performs the operations described herein to determine and display indicators of the health and status of the BOP stack 18. In this example, the monitoring system 25 can be realized by way of a computer system including a workstation 41 connected to a server 50 by way of a network. Of course, the particular architecture and construction of a computer system useful in the operations described herein can vary widely. For example, the monitoring system 25 can be realized by a single physical computer, such as a conventional workstation or personal computer, or alternatively by a computer system implemented in a distributed manner over multiple physical computers. Likewise, one or more of the computer systems, illustrated in FIG. 3, can be located at any geographic location, whether at the drilling rig 16 or remotely located, for example, on-shore. Accordingly, while FIG. 3 illustrates various components included in the monitoring system 25, the monitoring system 25 illustrated in FIG. 3 is exemplary and that additional components can be added and existing components can be removed.

As shown in FIG. 3 and as mentioned above, the monitoring system 25 can include the workstation 41 and the server 50. The workstation 41 can include a central processing unit 45, coupled to a system bus ("BUS") 43. The BUS 43 can be coupled to input/output interfaces 42, which refers to those interface resources by way of which peripheral functions ("P") 47 (e.g., keyboard, mouse, local graphics display DISP, etc.) interface with the other constituents of the workstation 41. The central processing unit 45 can refer to the data processing capability of the workstation 41, and as such can be implemented by one or more CPU cores, co-processing circuitry, and the like. The particular construction and capability of the central processing unit 45 can be selected according to the application needs of the workstation 41, such needs including, at a minimum, the carrying out of the functions described herein, and can also include such other functions as may be desired to be executed by computer system.

In the architecture of the monitoring system 25 according to this example, a system memory 44 can be coupled to the BUS 43, and can provide memory resources of the desired type useful as data memory for storing input data and the results of processing executed by the central processing unit 45, as well as program memory for storing the computer instructions to be executed by the central processing unit 45 in carrying out those functions. Of course, this memory arrangement is only an example, it being understood that the system memory 44 can implement such data memory and program memory in separate physical memory resources, or distributed in whole or in part outside of the workstation 41.

In addition, as shown in FIG. 3, measurement and feedback inputs ("inputs") 48 can acquire, from downhole sensor measurements, feedback signals from the blue control pod 28B and the yellow control pod 28Y, inputs from the drilling control computer 22 and the BOP control computer 24, and the like. The inputs 48 can be received by the workstation 41 via the input/output interfaces 42, and can be stored in a memory resource accessible to the workstation 41, either locally or via a network interface 46.

The network interface 46 of the workstation 41 can be a conventional interface or adapter by way of which the workstation 41 can access network resources on a network. As shown in FIG. 3, the network resources to which the workstation 41 has access via the network interface 46 can include the server 50, which resides on a local area network, or a wide-area network such as an intranet, a virtual private network, or over the Internet, and which can be accessible to the workstation 41 by way of one of those network arrangements and by corresponding wired or wireless (or both) communication facilities. In embodiments, the server 50 can be a computer system, of a conventional architecture similar, in a general sense, to that of the workstation 41, and as such includes one or more central processing units, system buses, and memory resources (program and data memory), network interface functions, and the like.

In addition, a library 52 can also be available to the server 50 (and the workstation 41 over the local area or wide area network), and can store risk profile rule sets, previous blowout preventer control situational results, and other archival or reference information useful in the monitoring system 25. The library 52 can reside on another local area network, or can be accessible via the Internet or some other wide area network. It is contemplated that the library 52 can also be accessible to other associated computers in the overall network. It is further contemplated that the server 50 can be located on-shore or otherwise remotely from the drilling platform 20 and that additional client systems 51 can be coupled to the server 50 via the local area or wide area network, to allow remote viewing on-shore and/or offshore, and analysis of the BOP stack 18 in a similar manner as at the monitoring system 25 at the platform 20, and to also allow further additional analysis.

The particular memory resource or location at which the measurements, the library 52, and program memory containing the executable instructions according to which the monitoring system 25 can carry out the functions described herein can physically reside in various locations within or accessible to the monitoring system 25. For example, these program instructions can be stored in local memory resources within the workstation 41, within the server 50, in network-accessible memory resources to these functions, or distributed among multiple locations, as known in the art. It is contemplated that those skilled in the art will be readily able to implement the storage and retrieval of the applicable measurements, models, and other information useful in connection with embodiments described herein, in a suitable manner for each particular application. In any case, according to embodiments, program memory within or accessible to the monitoring system 25 can store computer instructions executable by the central processing unit 45 and the server 50, as the case may be, to carry out the functions described herein, by way of which determinations of the status and health of the BOP stack 18 (both currently and over at least recent history) can be generated.

The computer instructions can be in the form of one or more executable computer programs, or in the form of source code or higher-level code from which one or more executable computer programs are derived, assembled, interpreted or compiled. Any one of a number of computer languages or protocols can be used, depending on the manner in which the desired operations are to be carried out. For example, the computer instructions can be written in a conventional high level language, either as a conventional linear computer program or arranged for execution in an object-oriented manner. The computer instructions can also be embedded within a higher-level application. Likewise, the computer instructions can be resident elsewhere on the local area network or wide area network, or downloadable from higher-level servers or locations, by way of encoded information on an electromagnetic carrier signal via some network interface or input/output device. The computer instructions can have originally been stored on a removable or other non-volatile computer-readable storage medium (e.g., a DVD disk, flash memory, or the like), or downloadable as encoded information on an electromagnetic carrier signal, in the form of a software package from which the computer instructions were installed by the monitoring system 25 in the conventional manner for software installation. It is contemplated that those skilled in the art having reference to this description will be readily able to realize, without undue experimentation, embodiments in a suitable manner for the desired installations.

According to embodiments, the monitoring system 25 can operate according to a graphical user interface (GUI), displayed at its graphics display ("DISP") 53, that can present indications of the health and status of the BOP stack 18 to personnel located at the platform 20 and/or to personnel located remotely, for example, on-shore. According embodiments, the health and status indications presented at the DISP 53 includes current (i.e., "real-time") health and status information, a recent history of these health and status indicators, and also other information such as dates of the most recent functional tests of the BOP stack 18. In embodiments, this information can be presented simultaneously, by way of a single GUI window at the DISP 53. In addition, the monitoring system GUI can include the ability to rapidly access underlying data and information, for example by way of clickable "live" links implemented in combination with the health and status indicators.

According to embodiments, the monitoring system 25 can operate to allow the personnel located at the platform 20 and/or to allow the personnel located remotely, for example, on-shore, to alter the indications of the health and status of the BOP stack 18 and/or to input the indications of the health status of the BOP stack 18. The monitoring system 25 can receive the alterations to or input of the health and status of the BOP stack 18 by way of P 47 (e.g., keyboard, mouse, local graphics display DISP, etc.)

Figure 4:
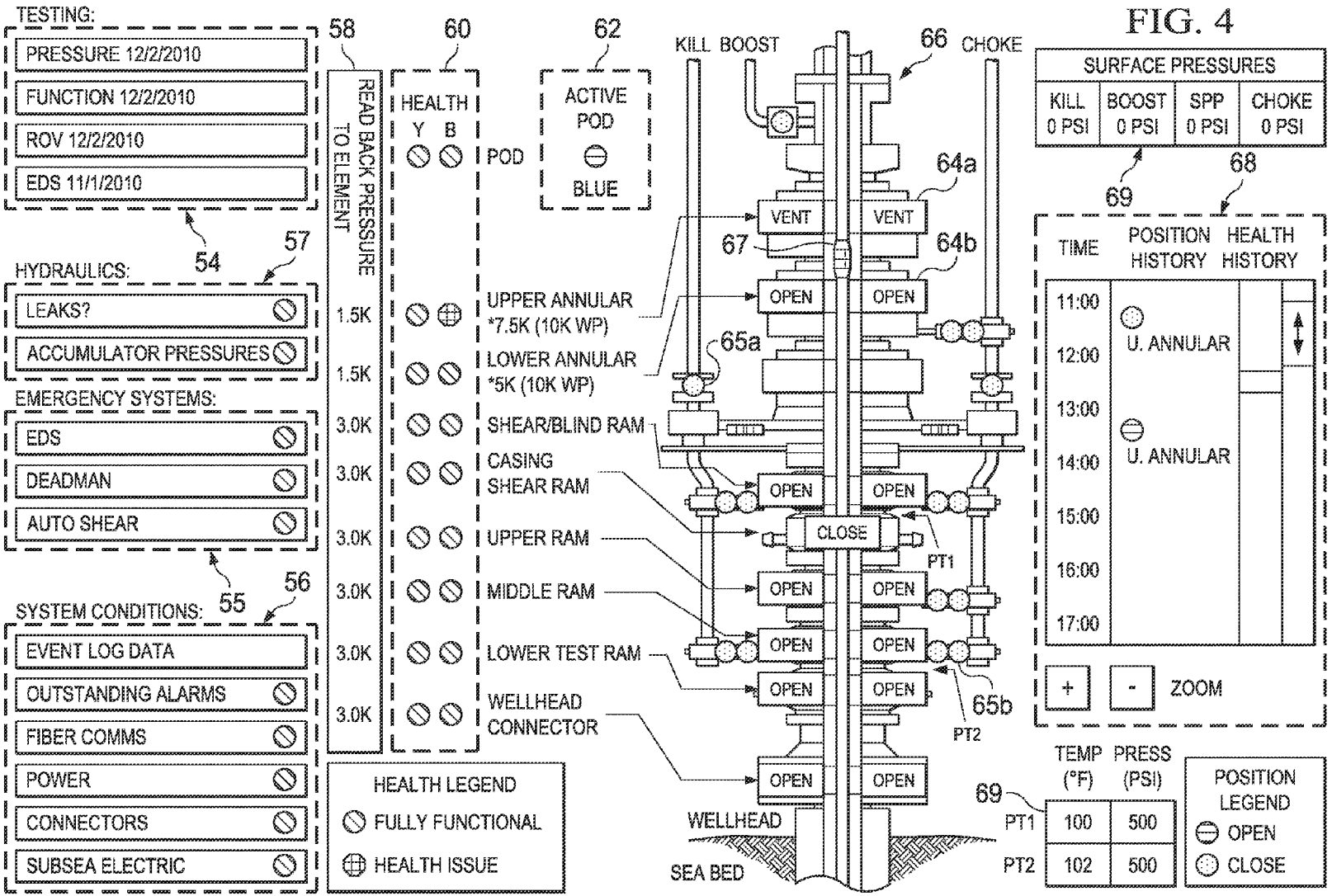
FIG. 4 is a view of the graphics display of the monitoring system illustrating an example of the displayed output of blowout preventer stack health and status, according to embodiments.

FIG. 4 illustrates an example of the graphical user interface of the monitoring system 25, as displayed at the DISP 53, according to embodiments. The GUI can include various fields or frames in which information regarding the BOP stack 18 can be displayed. While FIG. 4 illustrates various types of information and indicators, one skilled in the art will realize that FIG. 4 is exemplary and that additional types of information and indicators can be added and existing types of information and indicators can be removed.

As illustrated in FIG. 4, the DISP 53 can present testing indicators 54, by way of which the most recent tests of the BOP stack 18 can be identified by date. As shown in FIG. 4, these functional tests can include pressure testing of the individual seals of the BOP stack 18 (i.e., to determine whether the seal meets its pressure rating), functional testing of each seal (i.e., to determine functional operation of the seal), testing to determine if a remotely-operated-vessel ("ROV") can successfully actuate each seal of the BOP stack 18, and functional testing of the emergency disconnect sequence ("EDS"). An example of such a test is described in U.S. Patent Application Publication No. US2008/01815143 A1, commonly assigned herewith and incorporated herein, in its entirety, by this reference. The displayed dates of the most recent instance of each of these tests, as shown in FIG. 4, can allow platform personnel to schedule the next instance of those tests as specified by operational practice or regulations. In addition, if one of the other readings or indications regarding a system indicate a potential problem, the time elapsed since the most recent functional test of the problematic element can be useful information. In addition, it is contemplated that each of the displayed elements within the testing indicators 54 can operate as a live link, such that the monitoring system 25 can present a pop-up window or other new display with detailed information regarding detailed history and results of the corresponding functional test.

Emergency system health indicators 55, which can be presented by the monitoring system 25 at the DISP 53, can provide indications of the overall "health" of certain emergency control systems for the BOP stack 18. In embodiments, the "health" of the subsystem can refer to the functionality and performance of the control system in actuating and otherwise operating a corresponding sealing element or other subsystem, such functionality not only including the control system (i.e., proper operation of the logic and signal communication); to leak detection in the hydraulic control system, and to the ability of the mechanical blowout preventer element to respond to the control system (e.g., does the sealing element move when actuated, etc.). In embodiments, the emergency system health indicators 55 can be presented in a binary "traffic light" format that indicates two levels of health, e.g., green=fully functional and yellow=health issue. Likewise, the emergency system health indicators 60 can be presented in any "traffic light" format that indicates various levels of health (e.g., green=good health; yellow=questionable health; red=poor health).

FIG. 4 illustrates the emergency system health indicators 55 as including an indicator for the emergency disconnect sequence (EDS) function, another indicator for the "deadman" operational function (i.e., the sealing element operating if both of its electrical and hydraulic control systems are failed), and another indicator for the "auto shear" emergency system (i.e., shearing the connection between the LMRP and the lower portion of blowout preventer 18 in the appropriate emergency situation). Of course, additional or fewer emergency subsystems and functions can also be analyzed and their "health" indicated by a corresponding emergency system health indicator 55, as desired. In addition, it is contemplated that each of the displayed elements within emergency system health indicators 55 can operate as a live link, such that the monitoring system 25 can present a pop-up window or other new display with detailed information regarding detailed history and status of the corresponding system.

System conditions indicators 56 can be related to various system conditions concerning the BOP stack 18 that are useful to monitor by way of the monitoring system 25. In this example, the health of the various electrical, communications, and power systems (e.g., fiber communications, power systems, connectors in the BOP stack 18, and subsea electrical systems) can be assigned a "traffic light" indicator. Functional status of certain electrical subsystems such as continuity and performance of the communications link, primary and backup power status, and the functionality of the drilling control computer 22 and the BOP control computer 24 can be indicated by the system conditions indicators 56. Additional system conditions indicators 56 can be displayed, as desired. In addition, the "Event Logger" tab within the system conditions indicators 56 can provide a live link by way of which personnel can open a new GUI window to view a log of events and alarms concerning the BOP stack 18. In addition, it is contemplated that each of the system conditions indicators 56 can also operate as a live link, so that the monitoring system 25 can present a pop-up window or other new display with detailed information regarding detailed history and status of the corresponding system conditions.

Figure 8:
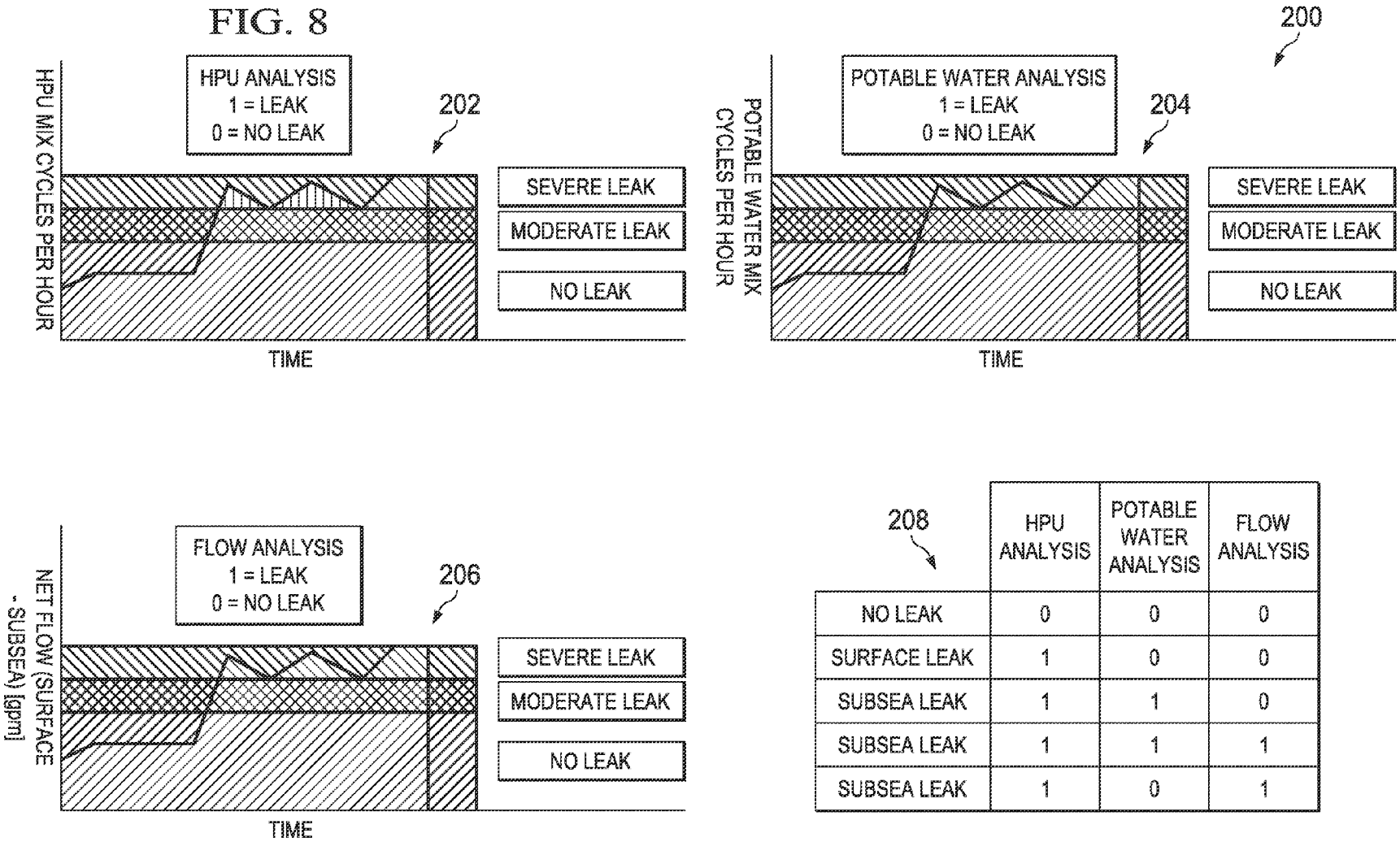
FIG. 8 is a generalized diagram illustrating another exemplary risk profile, according to embodiments.

The GUI can also provide hydraulics indicators 57 to display the heath of various components of the hydraulic system. For example, a hydraulic power unit can typically be deployed at the platform 20 in connection with the hydraulic system. The monitoring system 25 can monitor the status of flow rates of potable water and surface flow supplying the downstream components in the hydraulic system, the status of pumps feeding the accumulator banks, system pressure and available air pressure for the primary and secondary pneumatic systems of the hydraulic power unit, and also the position of control values used on this hydraulic power unit. The monitoring system 25 can display these statuses in the hydraulics indicators 57 at the DISP 53. Likewise, the monitoring system 25 can include the data into the health determination of the BOP stack 18 and its various systems. In addition, the monitoring system 25 can monitor and display the status (e.g., start or stop) of the hydraulic power unit, as well as identify trends in the history of start and stop cycles over time, for example, as illustrated in FIG. 8 described below.

The GUI, which can be presented at the DISP 53 by the monitoring system 25, can also include read back pressure indicators 58 for various elements of the BOP stack 18. As known in the art, solenoid control valves can typically be used to hydraulically actuate sealing elements of the BOP stack 18. An indication of the functionality of a given control valve and the actuated sealing element can be evaluated by sensing the "read back" pressure for a given "pilot pressure" applied to the control valve. The read back pressure indicators 58 can provide current sensed read back pressures at various elements (e.g., the upper annular element 32, the lower annular element 34, the blind shear ram element 35, the casing shear ram element 36, the upper ram element 37, the middle ram element 38, and the lower test ram element 39 of the BOP stack 18). An increase in this "read back" pressure for a given element over time, from a nominal value, can indicate the need for testing and maintenance.

Health indicators 60 can be provided by the GUI displayed at the DISP 53 of the monitoring system 25. According to embodiments, the health indicators 60 can be presented in "traffic light" format indicating various levels of health. For example, as illustrated, the health indicators 60 can be presented in a binary "traffic light" format that indicates two level of health, e.g., green=fully functional and yellow=health issue, for each sealing element or connector of interest in the BOP stack 18. Likewise, the health indicators 60 can be presented in any "traffic light" format that indicates various levels of health (e.g., green=good health; yellow=questionable health; red=poor health), for each sealing element or connector of interest in the BOP stack 18. In this context, the health of a given sealing element refers to the functionality of both the control system of the BOP stack 18 relative to that element, and also the actuating members (control valves, actuators, and the parts of the sealing element moved thereby) of the sealing element. In other words, a failure either within the control system or in the response of the sealing element to actuate by the control system will be reflected as poor health, within the context of the health indicators 60. As described above, the blue control pod 28B and the yellow control pod 28Y can be redundant and can be deployed in the BOP stack 18. As such, the health indicators 60 can indicate the health of each sealing element of the BOP stack 18 in conjunction with each of the blue control pod 28B and the yellow control pod 28Y. The manner in which the monitoring system 25 determines the relative health of these sealing elements (as well as the emergency system health indicators 55, the system conditions indicators 56, and the hydraulics indicators 57) will be described in further detail below.

Pictorial display 66 can provide a visual representation of the BOP stack 18, and the current status of its sealing elements, hydraulic valves, and the like. Typically, this visual representation of the BOP stack 18 can correspond closely to the specific BOP stack 18 being monitored. For example, the library 52, as illustrated in FIG. 3, can store such a visual representation for various types and models of blowout preventers, such that the workstation 41 can retrieve the appropriate representation at the time of establishing the monitoring program for the BOP stack 18. Also in this example, the pictorial display 66 can present a brief textual description of each sealing element, including in some cases its pressure rating (e.g., "Upper Annular 7.5K, 10K WP").

In embodiments, the pictorial display 66 can include an active pod indicator 62 that indicate which of the blue control pod 28B or the yellow control pod 28Y is currently active (for purposes of controlling the BOP stack 18). In this case, the active control indicator 62 can indicate that the blue control pod 28B is active and that the yellow control pod 28Y is inactive. Sealing indicators 64*a*, 64*b*, etc. can be provided in the pictorial display 66 for each sealing element of the BOP stack 18, to indicate the current position (open, block/vent, or close) of that corresponding sealing element. Valve indicators 65*a*, 65*b*, etc. can also be provided to show the current status of various hydraulic valves in the hydraulic system. In this example, the pictorial display 66 can show that a given hydraulic valve is closed at the point at which the valve indicator 65*a*, 65*b*, etc. is present; other elements in the pictorial display 66 in which the valve indicator 65 is not present are thus shown as open.

In embodiments, the pictorial display 66 can provide an indication of the location of a tool joint along the drill pipe 10 within the BOP stack 18, by way of a visual element 67. It is important for the operator to be aware of tool joints and other elements along the drill pipe 10 within the BOP stack 18, so that operation of the BOP stack 18 in sealing the wellbore can take such features into account. In this example, a tool joint is shown by the visual element 67 between the upper annular and lower annular elements. This indicator thus provides important real-time information regarding the status of the BOP stack 18 to the on-platform personnel.

A history frame 68 can provide a recent history of events encountered at the BOP stack 18. In this example, a time strip can be shown along the left-hand side of the history frame 68 (11:00 through 17:00, for instance). The position history frame in the center of the history frame 68 can indicate events such as the closing and opening of sealing elements. In the example of FIG. 4, the history frame 68 can show that the upper annular sealing element was closed at about 11:15, and opened at about 13:15. The history frame 68 also includes a "Health History" portion along its right-hand side, in which those times at which poor health was displayed for any element or portion of the BOP stack 18 is shown. In this example, a poor health indication was active from about 12:30 to about 12:45. Further information regarding the issue during that period of time may be retrieved by the user, for example by clicking on that indicator within the history frame 68. The history frame 68 can also include a zoom widget that allows an operator to change the time frame displayed in the history frame 68.

The history frame 68 can be especially useful in the on-platform context. As known in the art, certain alarm conditions may be temporary, because of response by personnel to the alarm condition or because the alarm condition was intermittent or self-clearing in some manner. However, the existence of an intermittent or periodic alarm condition may be important information to the drilling personnel, as indicative of an unstable condition or of an element that is nearing failure. But for various reasons, personnel may not be constantly viewing the DISP 53 of the monitoring system 25, for example because those personnel are required to carry out a different task involved in the drilling operation. The recent history of the monitoring system 25 and the BOP stack 18, as shown in the history frame 68 can inform the on-platform personnel of the existence of such temporary poor health indications within the recent past. If only current conditions were visible at the DISP 53, these past intermittent or temporary alarm conditions could only be found by analysis of logged data and measurements.

It is contemplated that the health and status of other systems and subsystems at the drilling rig 16 pertinent to the functioning and operation of the BOP stack 18 can also be monitored by monitoring system and presented at the DISP 53. As known in the art, various surface valves associated with a "choke and kill" manifold are deployed top-side at the platform 20, such surface valves including gate valves, chokes on the physical choke manifold, and associated high pressure pipe work from the slip joint termination through the manifold and the mud gas separator. The monitoring system 25 can monitor and display the positions of these surface valves at the DISP 53, based on mechanical inputs from those valves, according to embodiments. Likewise, the GUI can provide additional indicators 69 that can display information, such as temperature and pressure readings from BOP sensors PT1 and PT2, surface pressure reading, and the like. For example, a diverter system is often deployed topside at the platform 20, in connection with the BOP stack 18. This diverter system can be typically supplied with pressure from the hydraulic power unit and has its own dedicated accumulator bank. The monitoring system 25 can also monitor the system pressure, valve position, regulator pilots, and supply pressure for the diverter system, along with the pressure and status of slip joint packers, and the associated system air pressure. These inputs can be directly displayed at the DISP 53 by the monitoring system 25, or included in the analysis of the health of the BOP stack 18, or both.

Figure 5:
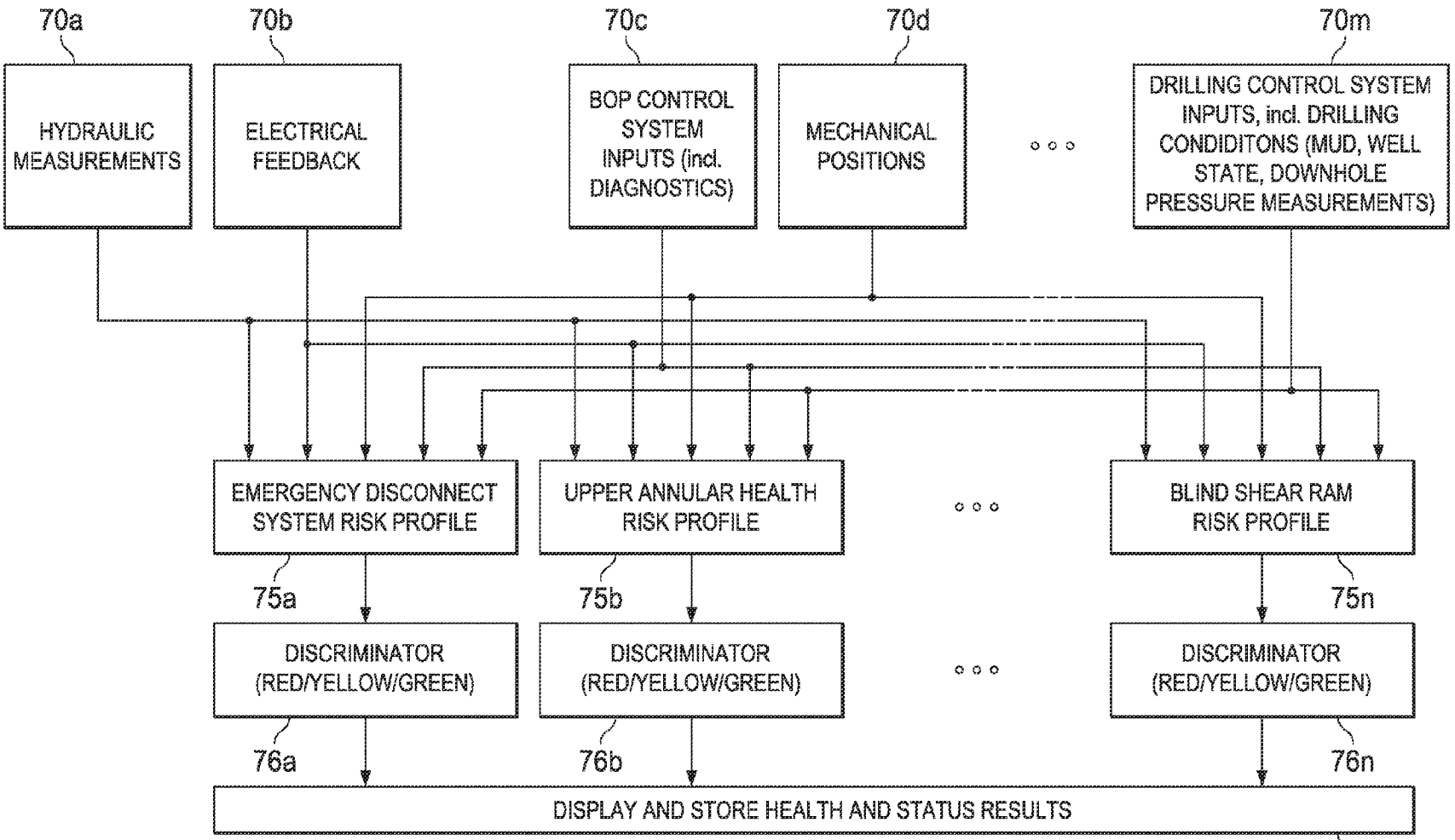
FIG. 5 is a flow diagram illustrating the operation of the monitoring system in determining the health and status of the blowout preventer stack, according to embodiments.

FIG. 5 illustrates the operation of the monitoring system 25 in determining and displaying the various health indicators within the GUI presented by the DISP 53 to on-platform personnel. It is contemplated that this operation of the monitoring system 25 can be carried out by way of the execution of computer program instructions, for example as stored within computer readable storage media within the workstation 41 or, in the "web applications" context, at the server 50, in the library 52, or otherwise accessible to the workstation 41. Therefore, this description will refer to certain operations as executed by the monitoring system 25 in the general sense, with the understanding that the particular computing resource involved in such execution can reside locally at the platform 20, remotely from the platform 20, or both, as the case may be. In any event, it is contemplated that the DISP 53 at which these health indicators are presented will generally be deployed at the platform 20, or at such other location at which on-site drilling personnel will be present.

Various inputs, signals, and data can be received by the monitoring system 25, both from downhole sources and also from sources at the surface (i.e., from systems and sensors at the platform 20) in its determination of the health of various elements and systems in the BOP stack 18. In the example of FIG. 5, hydraulic measurements can be acquired in a process 70*a* from the BOP stack 18, such measurements including both measured values (pressures, volumes, etc.) and also status indicators (valve open, valve closed, etc.). These hydraulic measurements acquired in the process 70*a* can be direct measurements of hydraulic parameters, can be ancillary measurements (such as temperatures, voltages, currents, hydraulic fluid flow rates, and other measurements pertaining to the hydraulic system) or can refer indirectly to those parameters. These hydraulic measurements can be obtained at the blue control pod 28B and/or the yellow control pod 28Y, or from sensors deployed in the BOP stack 18 below the LMRP. In a process 70*b*, various electrical feedback signals can be acquired by the monitoring system 25 from the BOP stack 25, such signals including feedback signals obtained by the blue control pod 28B and/or the yellow control pod 28Y in their feedback control loops, indications of signal quality in the communication links between the platform 20 and the BOP stack 18, or other downhole elements, and the like. In a process 70*c*, inputs from the BOP control computer 24, including the results of diagnostic processes relevant to the blue control pod 28B and the yellow control pod 28Y can be obtained by the monitoring system 25; such diagnostic results are important in determining the health of those control systems. Signals indicative of the mechanical position of the sealing elements and control valves of the BOP stack 18 can similarly be acquired in a process 70*d*. Typically, these mechanical positions can be based on electronic indications of control inputs at the platform 20; in some newer blowout preventers, downhole sensors can directly measure ram position and other mechanical data, which can be also acquired in the process 70*d*. In a general sense, many other types of inputs, signals, and data can be acquired by the monitoring system 25 in this embodiment of the invention, to the extent that such acquired information is useful in determining the health of various systems and elements within the BOP stack 18, as may be determined by those skilled in the art. In addition, according embodiments, information regarding the current drilling conditions can be acquired in a process 70*m*. This drilling condition information obtained in the process 70*m* can include measured parameters relative to the drilling fluid or mud, the current state of the well itself (drilling, circulating, whether casing is complete, depth, whether non-shearable pipe is disposed within blowout preventer 18, etc.), measurements regarding the downhole conditions at the bit or at the BOP stack 18 itself, such as downhole pressure, downhole temperature, other inputs from the drilling control computer 22, and the like. Other external information, such as the expected reservoir pressure or other attributes of the formation as obtained from seismic surveys, other wells in the area, and the like can also be acquired in the process 70*m*.

The monitoring system 25 can then apply these data, inputs, signals, and other information, acquired in the processes 70*a* through 70*m* to various risk profiles that have been defined and retrieved for each of the systems and elements to be analyzed. In the example of FIG. 5, in a process 75*a*, the monitoring system 25 can evaluate a risk profile for the emergency disconnect system, using the pertinent information acquired in the processes 70*a* through 70*m*. Similarly, in a process 75*b*, the monitoring system 25 can evaluate a risk profile for the upper annular sealing element based on the pertinent acquired information from processes 70*a* through 70*m*. In process 75*n*, the monitoring system 25 can evaluate the risk profile for the blind shear ram sealing element based on the pertinent measurements and other information acquired in the processes 70*a* through 70*m*. It is contemplated that a separate risk profile can be evaluated by the monitoring system 25, in a corresponding instance of a process 75, for each subsystem and element for which a health indicator is to be displayed in the GUI at the DISP 53. As such, the number of risk profiles evaluated by monitoring system 25 can vary depending on the particular blowout preventer, and the type of monitoring to be carried out.

Each risk profile can correspond to a rule set or heuristic by way of which a measure of the functionality and performance of the corresponding system or element of the BOP stack 18 can be generated. The complexity of each risk profile can vary widely, from a simple Boolean combination of various status and thresholds to an "artificial intelligence" type of combination of the input measurements and information. For example, the risk profiles can be determined as part of, or in a manner similar to, the intelligent drilling advisor described in U.S. Patent Application Publication No. US 2009/0132458 A1, commonly assigned herewith and incorporated herein, in its entirety, by this reference.

It is contemplated that these risk profiles can be derived to include the judgment of human experts and interested parties. For example, these risk profiles can be initially based on specifications and recommendations from the manufacturer of the BOP stack 18. The initial risk profile itself can be derived in whole or in part by the manufacturer. Particular drilling operators can also provide input into the risk profiles as implemented into the monitoring system 25, based on past experience and on the risk tolerable to the particular operator. Furthermore, the risk profile can be programmably adjusted once deployed in the field, again based on past experience and also based on the observed conditions at the particular well. In any event, the programmability of the risk factors can be carried out either at the platform 20, or more likely by an expert such as a subsea engineer from a location remote from the platform 20, particularly if the risk profiles are stored in the library 52 or elsewhere within the overall network accessible to the monitoring system 25. For example, the various risk profiles 75 can be programmed remotely from the platform 20, with the server 50 evaluating those risk profiles based on inputs gathered from the platform 20, and with the results displayed at the monitoring system 25 at the platform 20 and the remote clients 51. Other implementations are of course also contemplated.

Figure 6:
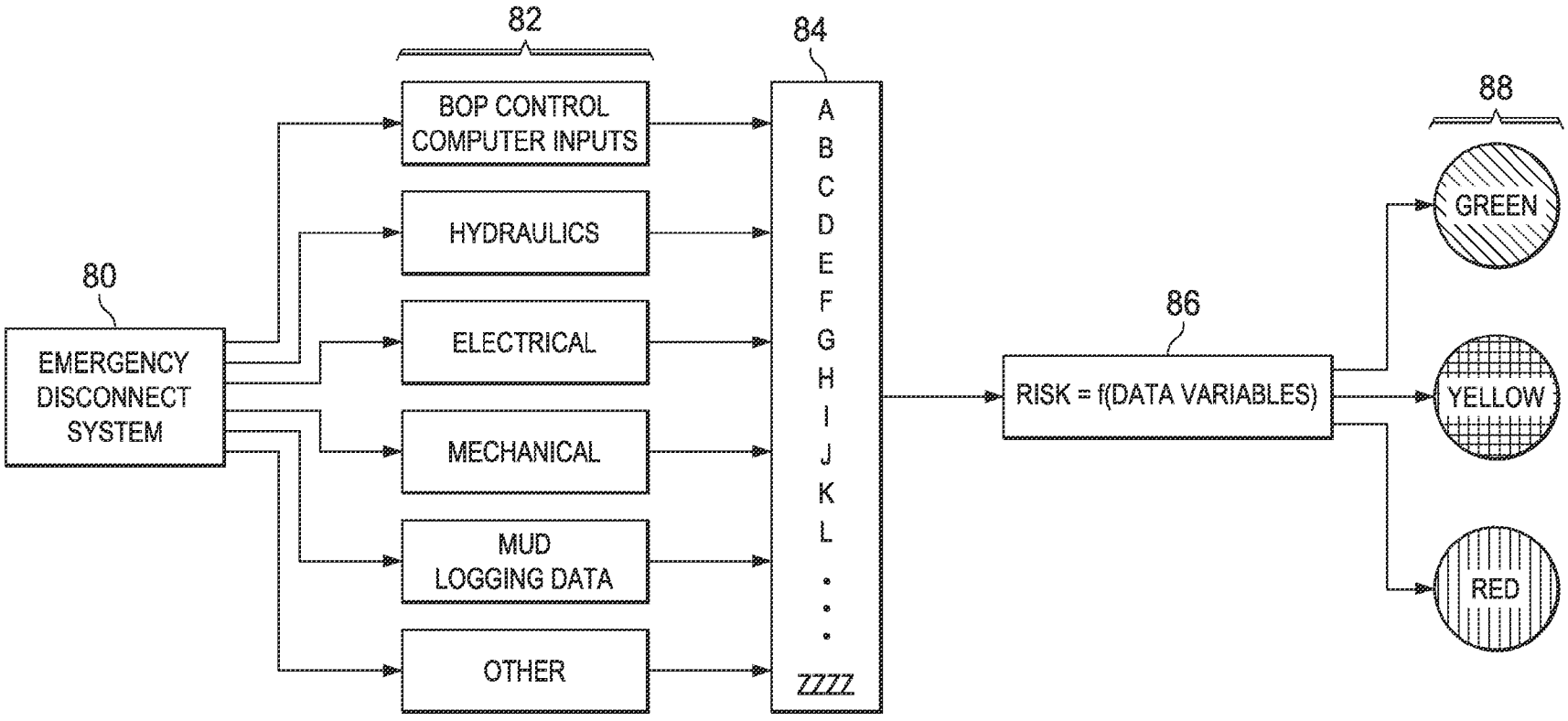
FIG. 6 is a data flow diagram illustrating an example of a health determination, according to embodiments.

FIG. 6 illustrates an example of the data flow involved in the evaluation of the risk profile for an emergency disconnect system 80, performed by the monitoring system 25 in process 75*a* of FIG. 5. Requirements set 80 for the emergency disconnect system 80 can identify the particular inputs and information that have been deemed to be useful in evaluating the health of the emergency disconnect system 80. These requirements can point to various input values 82 as acquired by the monitoring system 25 in processes 70*a* through 70*m*, for example can include specific values obtained in the process 70*a* from the hydraulics system, in the process 70*b* from the electrical system, in the process 70*m* as concerning drilling mud logging data, and in other similar processes 70 regarding the mechanical properties of the BOP stack 18 and other pertinent inputs. The current values for these various selected input values 82 can then be mapped into variables 84 that the monitoring system 25 can apply to a risk function 86. Such mapping may involve other operations, such as normalizing the input values 82 into a common range, and the like. Risk function 86, in this example, can determine a result indicative of the level of risk associated with emergency disconnect system (i.e., the risk that the system will not operate properly, or even if it does operate properly, provide the desired protection under current conditions). Likewise, the risk function 86 can determine a result indicative of a level of redundancy in the emergency disconnect system and of conditions in the emergency disconnect system varying from "normal" operating conditions. As discussed above, the risk function 86 can be relatively simple, such as a simple Boolean combination of the inputs 82 (e.g., whether the various inputs exceed a threshold), a weighted sum or other linear combination of the normalized inputs 82, or a complex "neural net" or other AI-like combination of those the inputs 82. The result of this evaluation is then translated into the "traffic light" health indicators 88, as shown in FIG. 6. While FIG. 6 can be performed by the monitoring system 25, one skilled in the art will realize that any computer system illustrated in FIG. 3 can perform all or part of the process illustrated in FIG. 6.

Likewise, as mentioned above, a user of the monitoring system 25 can alter or input the heath status to be displayed in the health indicators 88. For example, in the processes described above, the monitoring system 25 can determine that the emergency disconnect system is experience a problem and determine a warning should be displayed as a yellow "traffic light" in the health indicators 88. Upon review of the conditions causing the yellow "traffic light," the user of the monitoring system 25 can decide to upgrade the heath status to a red "traffic light," e.g. non-functioning. The monitoring system 25 can receive the input, from the user, to change the health indicators 88 and alter the heath indicators 88 to display a red "traffic light". One skilled in the art will realize that a user of the monitoring system 25 can alter the health indicators 88 and/or can input new health statuses for the heath indicators 88 based on any factors or conditions known to the user of the monitoring system 25.

Figure 7:
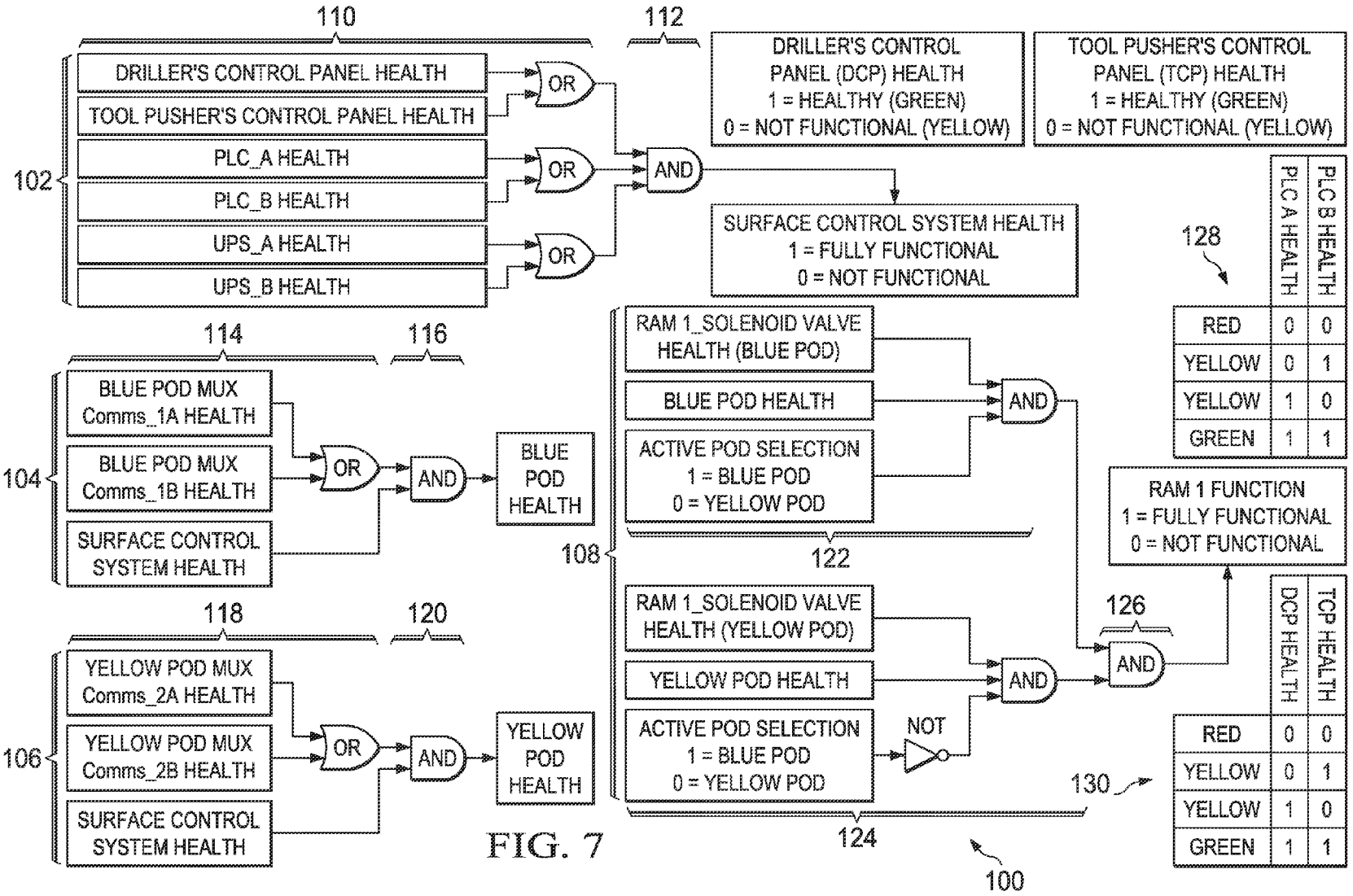
FIG. 7 is a generalized diagram illustrating an exemplary risk profile, according to embodiments.

FIG. 7 illustrates an example of a risk profile 100 that can be utilized by the monitoring system 25 to determine the health status of a ram element (e.g., the blind shear ram element 35, the casing shear ram element 36, the upper ram element 37, the middle ram element 38, and the lower test ram element 39) in the BOP stack 18, according to embodiments.

As illustrated in FIG. 7, the risk profile 100 can comprise a series of hierarchical Boolean logic stages 102, 104, 106, and 108. Each of the logic stages 102, 104, 106, and 108 can determine the heath of a system that contributes to the overall health of the ram element. In this example, each of the logic stages 102, 104, 106, and 108 can comprise Boolean "or," "and," and "not" gates to determine a health of the system that contributes to the overall health of the ram element as well levels of redundancy in the system. In this example, a Boolean "1" can represent a functional system, and a Boolean "0" can represent a non-functional system.

As illustrated, the logic stage 102 can comprise two logic sub-stages 110 and 112 of Boolean "or" and "and" gates to determine the health status of the surface control systems. The logic sub-stage stage 110 can receive values that represent the health of a drillers control panel health and a tool pusher's control panel health. Likewise, the logic sub-stage 112 can receive values that represent the health of communications systems for the surface control system, such as PLC_A (programmable logic controller), PLC_B, UPS_A (uninterruptable power supply), and UPS_B. The logic sub-stage 110 can comprise three "or" gates that compare the drillers control panel health to a tool pusher's control panel health; the PLC_A health to the PLC_B heath; and the UPS_A health to the UPS_B health. In the logic sub-stage 110, the compared systems can be redundant systems. As such, the "or" gates can be utilized so that only a failure in both compared systems will result in a Boolean "0", i.e. non-functional, being passed to logic sub-stage 112. The logic sub-stage 112 can comprise a Boolean "and" gate to compare outputs from logic sub-stage 110. In this example, by using the Boolean "and" gate, the surface control system can be considered functional only if the outputs from the logic sub-stage 110 are all Boolean "1". In other words, at least one from each of the pair of redundant systems in the logic sub-stage 110 must be functional for the surface control system to be considered functional.

Further, as illustrated, the logic stage 104 can comprise two logic sub-stages 114 and 116 of Boolean "or" and "and" gates to determine the health of the blue control pod. The logic sub-stage stage 114 can receive values that represent the health of communication lines to the blue control pod, Blue MUX Comms_1A and Blue MUX Comms_1B. The logic sub-stage 114 can comprise one "or" gate that compares the Blue MUX Comms_1A health to the Blue MUX Comms_1B health. In the logic sub-stage 114, the Blue MUX Comms_1A and the Blue MUX Comms_1B can be redundant systems. As such, the "or" gate can be utilized so that only a failure in both the Blue MUX Comms_1A and the Blue MUX Comms_1B will result in a Boolean "0", i.e. non-functional, being passed to logic sub-stage 116. The logic sub-stage 116 can comprise a Boolean "and" gate to compare output from logic sub-stage 114 to the health of the surface control system determined in logic stage 102. In this example, by using the Boolean "and" gate, the blue control pod can be considered functional only if the output from the logic sub-stage 114 and the health of the surface control system are both Boolean "1". In other words, at least one of the Blue MUX Comms_1A or the Blue MUX Comms_1B must be functional, and the surface control system must be functional for the blue control pod to be considered functional.

Additionally, as illustrated, the logic stage 106 can comprise two logic sub-stages 118 and 120 of Boolean "or" and "and" gates to determine the health of the yellow control pod. The logic sub-stage 118 can receive values that represent the health of communication lines to the yellow control pod, yellow MUX Comms_1A and yellow MUX Comms_1B. The logic sub-stage 118 can comprise one "or" gate that compares the yellow MUX Comms_1A health to the yellow MUX Comms_1B health. In the logic sub-stage 118, the yellow MUX Comms_1A and the yellow MUX Comms_1B can be redundant systems. As such, the "or" gate can be utilized so that only a failure in both the yellow MUX Comms_1A and the yellow MUX Comms_1B will result in a Boolean "0", i.e. non-functional, being passed to logic sub-stage 120. The logic sub-stage 120 can comprise a Boolean "and" gate to compare output from logic sub-stage 118 to the health of the surface control system determined in logic stage 102. In this example, by using the Boolean "and" gate, the yellow control pod can be considered functional only if the output from the logic sub-stage 118 and the health of the surface control system are both Boolean "1". In other words, at least one of the yellow MUX Comms_1A or the yellow MUX Comms_1B must be functional and the surface control system must be functional for the yellow control pod to be considered functional.

Further, as illustrated, the logic stage 108 can comprise three logic sub-stages 122, 124, and 126 of Boolean "or," "and," and "not" gates to determine the overall health of the ram element. The logic sub-stage stage 122 can receive values that represent the health of a solenoid valve for the ram element controlled by the blue control pod, the blue control pod health determined in logic stage 104, and whether the blue control pod is selected. In this example, by using the Boolean "and" gate, the logic sub-stage 122 outputs a Boolean "1" if the output from the solenoid valve controlled by the blue control pod is functional, the blue control pod is functional, and the blue control pod is selected.

The logic sub-stage 124 can receive values that represent the health of a solenoid valve for the ram element controlled by the yellow control pod, the yellow control pod health determined in logic stage 106, and whether the yellow control pod is selected. The logic sub-stage 124 can include a Boolean "not" gate to invert the value of the active control pod in order to correctly represent activation of the yellow control pod. In this example, by using the Boolean "and" gate, the logic sub-stage 122 outputs a Boolean "1" if the output from the solenoid valve controlled by the yellow control pod is functional, the yellow control pod is functional, and the yellow control pod is selected. The logic sub-stage 126 can include a Boolean "and" gate to compare the output of the logic sub-stages 122 and 124.

In embodiments, once the health of the ram element is determined, the health can be provided in the GUI and displayed on the DISP 53, for example, in the appropriate health indicator in the health indicators 60. For example, the heath can be provided in the health indicator as green for functional and yellow as non-functional.

In the example described above, the risk profile 100 can return a binary result representing functional or non-functional. However, the risk profile 100 can also be utilized to return different levels of functionality. For example, the risk profile 100 can be utilized to determine a three level health system, e.g., green—fully functional; yellow—no redundancy, but functional; and red—not functional. For instance, if a system is redundant, then poor health can be shown as yellow. If both redundant system are yellow, the health can be shown as red (not functional). If only one of the two redundant systems is poor health, the heath can be shown as yellow (no redundancy, but functional). This logic is illustrated in tables 128 and 130 of FIG. 7.

Likewise, for example, whether the yellow control pod or the blue control pod is active can be used in determining several levels of health. If the active control pod is the same pod as a poor health solenoid valve, the health can be shown as red (not functional). If the active pod has a good solenoid valve but the non-active pod has a bad solenoid valve, the health can be shown as yellow (no redundancy, but functional).

While the example illustrated in FIG. 7 utilize Boolean logic, one skilled in art will realize that any type of logic can be utilized as a risk profile, such as a weighted sum or other linear combination of the normalized inputs, or a complex "neural net" or other AI-like combination of those the inputs.

As described above, the heath of certain systems, such as the hydraulic system, can be determined by measuring various parameters in the systems, such as flow rates, pressures, temperatures, and the like and performing analysis on these parameters. FIG. 8 illustrates an example of a risk profile 200 that can be utilized by the monitoring system 25 to determine whether a surface leak and/or a subsea leak is present in the hydraulic system. In embodiments, rigid conduit leak, in the hydraulic system, can be determined by tending the high pressure pump ("HPU") cycles relative to a base line. In addition, using potable water mix cycles and comparing outputs from a surface flow meter and the subsea flow meter can be used to determine if a leak is at the surface or subsea. Surface equipment, (diverter, HPU, etc.) can be closed circuit and can have a "catch pan" system for fluid collection from leaks. Therefore, no potable water should be used when operating surface equipment even if a leak exists. The subsea system can be an open circuit, and a leak will require additional hydraulic fluid mixing (potable water+concentrate) beyond a normal base line.

Because the rigid conduit system is always under 5 k psi pressure, a leak can be present even when no subsea components are operating. If no operating is occurring and the HPU pump cycles are at a rate higher than normal, there can be a leak in the system. As such, the monitoring system 25 can utilize a HPU cycle analysis, a potable water mix cycles analysis, and a net flow analysis to determine if a surface leak and/or subsea leak exists in the hydraulic system. In particular, the monitoring system 25 can measure the HPU Mix cycles, the potable water mix cycles, and the net flow in the hydraulic system. Graphs 202, 204, and 206 illustrated the HPU mix cycles per hour, the potable water mix cycles per hour, and the net flow gallons per minute, respectively. Once measured, the monitoring system 25 can perform an analysis on each to determine if a leak is present. As shown, the monitoring system 25 can examine the HPU Mix cycles per hour, the potable water mix cycles per hour, and the net flow gallons per minute to determine if each value exceeds a threshold indicting a leak, represented by the Boolean "1". The threshold can be any value that indicates a possible leak. In this example, trending may need to start with either time interval between pump cycles or pressure loss over time. There can be a leak on the surface that is venting back to the tank. In this scenario, no potable water would be used. Likewise, some systems can incorporate return to surface hydraulics which can affect the use of potable water mix cycles.

Once the HPU mix cycles per hour, the potable water mix cycles per hour, and the net flow are analyzed, the monitoring system 25 can apply the determined Boolean value ("1" leak and "0" no leak) to a risk logic to determine if a leak is present at the surface, subsea, both, or neither. Table 208 shows an example of the risk logic that can be utilized by the monitoring system 25. Once applied to the logic, the monitoring system 25 can display the possible leak in an indicator of the GUI, for example, hydraulics indicators 57.

Referring back to FIG. 5, discriminator processes 76*a* through 76*n* can be executed by monitoring system 25, based on the results of corresponding evaluation processes 75*a* through 75*n*. The discriminators evaluated in processes 76*a* through 76*n* can assign the "traffic light" indicators to the evaluated system or sealing element, for the DISP 53 via the GUI of FIG. 4, based on the output from the risk profile evaluation processes 75*a* through 75*n*. For example, if the risk function 86 is evaluated as shown in FIG. 6, discriminator process 76*a* can have at least two threshold values against which the output of the risk function 86 can be compared to determine the color of the health "traffic light" indicator. Other approaches to the discriminator processes 76*a* through 76*n*, of varying complexity, can be applied to the result of the risk profile evaluation processes 75*a* through 75*n*.

Upon determination of a health output from the corresponding discriminator process 76, the result of the health determination can be displayed at the DISP 53 via the GUI, as described above in connection with FIG. 4. This health result can also be stored in computer readable storage media of the monitoring system 25, in association with a time stamp for that result, for purposes of logging, and also for display in the history frame 68 described above relative to FIG. 4. For example, as shown in the history frame 68 of FIG. 4, the times during which a particular element exhibits poor health can be displayed. These results can also be communicated via the network of FIG. 3 to off-site locations for analysis by expert personnel. In addition, the results regarding the health and status of the BOP stack 18 can serve as inputs into the development of new rule sets and heuristics useful in the overall drilling process, as described in the above-incorporated U.S. Patent Application Publication No. US 2009/0132458 A1. In any case, the monitoring system 25 can repeat the process flow shown in FIG. 5 for each of the systems and elements being monitored, to carry out the desired continuous real-time monitoring of the health of the BOP stack 18.

Embodiments of this invention provide important advantages in the drilling operation, and particularly in the monitoring of the status of blowout preventers. A graphical user interface can be provided by way of which on-site personnel can readily and instantly view the current health of the blowout preventer, without poring through pages of measurement data and detailed analysis, and without requiring those personnel to have a high degree of skill and experience in the analysis of blowout preventer operation. This graphical user interface can also provide a quick view of the past health history of the blowout preventer, so that the on-site personnel need not be constantly viewing the display (or analyze data logs) in order to detect intermittent and temporary alarm conditions and the like. As such, it is contemplated that this invention can provide on-site drilling personnel with the ability to more confidently and rapidly respond to changing conditions that implicate the blowout preventer, resulting in safer drilling operations.

Certain embodiments may be performed as a computer application or program. The computer program may exist in a variety of forms both active and inactive. For example, the computer program can exist as software program(s) comprised of program instructions in source code, object code, executable code or other formats; firmware program(s); or hardware description language (HDL) files. Any of the above can be embodied on a computer readable medium, which include computer readable storage devices and media, and signals, in compressed or uncompressed form. Exemplary computer readable storage devices and media include conventional computer system RAM (random access memory), ROM (read-only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the present teachings can be configured to access, including signals downloaded through the Internet or other networks. Concrete examples of the foregoing include distribution of executable software program(s) of the computer program on a CD-ROM or via Internet download. In a sense, the Internet itself, as an abstract entity, is a computer readable medium. The same is true of computer networks in general.

While the teachings have been described with reference to the exemplary embodiments thereof, those skilled in the art will be able to make various modifications to the described embodiments without departing from the true spirit and scope. The terms and descriptions used herein are set forth by way of illustration only and are not meant as limitations. In particular, although the method has been described by examples, the steps of the method may be performed in a different order than illustrated or simultaneously. Furthermore, to the extent that the terms "including", "includes", "having", "has", "with", or variants thereof are used in either the detailed description and the claims, such terms are intended to be inclusive in a manner similar to the term "comprising." As used herein, the terms "one or more of" and "at least one of" with respect to a listing of items such as, for example, A and B, means A alone, B alone, or A and B. Those skilled in the art will recognize that these and other variations are possible within the spirit and scope as defined in the following claims and their equivalents.

What is claimed is:

1. A method for monitoring a blowout preventer in a well system, comprising:

acquiring values that correspond to operating conditions of subsystems of the well system, wherein the subsystems control and operate the blowout preventer;

evaluating, by a processor, a risk profile for a component of the blowout preventer based on a portion of the values that are associated with the component;

selecting a health indicator for the component of the blowout preventer based on a result of evaluating the risk profile, wherein the health indicator indicates a level of risk that the component of the blowout preventer will not provide a desired protection under current conditions; and displaying, at a graphics display, the health indicator for the component of the blowout preventer.

2. The method of claim 1, the method further comprising: evaluating, by the processor, a second risk profile for a second component of the blowout preventer based on a second portion of the values that are associated with the second component of the blowout preventer;

selecting a second health indicator for the second component of the blowout preventer that represents a result of evaluating the second risk profile; and simultaneously displaying, at the graphics display, the second health indicator for the second component of the blowout preventer and the health indicator for the component of the blowout preventer.

3. The method of claim 1, the method further comprising:

storing, in a computer readable storage medium, the health indicator in association with a time stamp;

acquiring new values corresponding to new operating conditions of the subsystems of the well system;

evaluating, by the processor, the risk profile for the component of the blowout preventer based on a portion of the new values that are associated with the component of the blowout preventer;

selecting a new health indicator for the component of the blowout preventer that represents a new result of evaluating the risk profile based on the new values; and displaying, at the graphics display, a new health indicator for the component of the blowout preventer as an update to the health indicator.

4. The method of claim 3, the method further comprising:

storing, in the computer readable storage medium, the new health indicator in association with a new time stamp; and displaying, at the graphics display, a history of the health indicator and the new health indicator in combination with times of the time stamp and the new time stamp.

5. The method of claim 1, wherein the values comprise one or more of:

hydraulic measurements at sealing components and subsea valves of the blowout preventer; status information, flow measurements, and pressure measurements associated with a hydraulic system of the well system; electrical feedback signals; diagnostic results from control systems of the blowout preventer; mechanical positions of sealing components and subsea valves of the blowout preventer; drilling conditions at a wellbore of the well system; surface valve positions and flow paths associated with the blowout preventer; and operating information, valve position, and pressure measurements associated with a diverter system of the well system.

6. The method of claim 1, wherein the displaying the health indicator comprises displaying a visual representation of the blowout preventer in which an operating condition of sealing components and control valves of the blowout preventer is indicated.

7. The method of claim 1, wherein the displaying the health indicator comprises displaying a date of a functional test of the blowout preventer.

8. The method of claim 1, the method further comprising: determining, from the values, a change in an operating condition for a sealing component of the blowout preventer; and displaying, at the graphics display, the change in the operating condition of the sealing component in combination with a time of the change.

9. The method of claim 1, wherein the component of the blowout preventer comprises one or more of:

a control system for a sealing component of the blowout preventer, an emergency system for the blowout preventer, and a component of a hydraulic system for the blowout preventer.

10. The method of claim 1, the method further comprising:

receiving, from a user, a change in the health indicator for the component of the blowout preventer; and displaying, at the graphics display, a new health indicator for the component of the blowout preventer that reflects the change received from the user.

11. The method of claim 1, wherein the health indicator indicates the level of risk that the component of the blowout preventer will not operate properly.

12. A system for monitoring a blowout preventer in a well system, comprising:

a computer readable storage medium storing instructions; and a processor coupled to the computer readable storage medium and configured to execute the instructions to perform the method comprising:

acquiring values that correspond to operating conditions of subsystems of the well system, wherein the subsystems control and operate the blowout preventer;

evaluating a risk profile for a component of the blowout preventer based on a portion of the values that are associated with the component;

selecting a health indicator for the component of the blowout preventer based on a result of evaluating the risk profile, wherein the health indicator indicates a level of risk that the component of the blowout preventer will not provide a desired protection under current conditions; and displaying, at a graphics display, the health indicator for the component of the blowout preventer.

13. The system of claim 12, wherein the processor is configured to execute the instructions to perform the method further comprising:

evaluating a second risk profile for a second component of the blowout preventer based on a second portion of the values that are associated with the second component of the blowout preventer;

selecting a second health indicator for the second component of the blowout preventer that represents a result of evaluating the second risk profile; and simultaneously displaying, at the graphics display, the second health indicator for the second component of the blowout preventer and the health indicator for the component of the blowout preventer.

14. The system of claim 12, wherein the processor is configured to execute the instructions to perform the method further comprising:

storing, in the computer readable storage medium, the health indicator in association with a time stamp;

acquiring new values corresponding to new operating conditions of the subsystems of the well system;

evaluating the risk profile for the component of the blowout preventer based on a portion of the new values that are associated with the component of the blowout preventer;

selecting a new health indicator for the component of the blowout preventer that represents a new result of evaluating the risk profile based on the new values; and displaying, at the graphics display, a new health indicator for the component of the blowout preventer as an update to the health indicator.

15. The system of claim 14, wherein the processor is configured to execute the instructions to perform the method further comprising:

storing, in the computer readable storage medium, the new health indicator in association with a new time stamp; and displaying, at the graphics display, a history of the health indicator and the new health indicator in combination with times of the time stamp and the new time stamp.

16. The system of claim 12, wherein the values comprise one or more of:

hydraulic measurements at sealing components and subsea valves of the blowout preventer; status information, flow measurements, and pressure measurements associated with a hydraulic system of the well system; electrical feedback signals; diagnostic results from control systems of the blowout preventer; mechanical positions of sealing components and subsea valves of the blowout preventer; drilling conditions at a wellbore of the well system; surface valve positions and flow paths associated with the blowout preventer; and operating information, valve position, and pressure measurements associated with a diverter system of the well system.

17. The system of claim 12, wherein the displaying the health indicator comprises displaying a visual representation of the blowout preventer in which an operating condition of sealing components and control valves of the blowout preventer is indicated.

18. The system of claim 12, wherein the displaying the health indicator comprises displaying a date of a functional test of the blowout preventer.

19. The system of claim 12, wherein the processor is configured to execute the instructions to perform the method further comprising:

determining, from the values, a change in an operating condition for a sealing component of the blowout preventer; and displaying, at the graphics display, the change in the operating condition of the sealing component in combination with a time of the change.

20. The system of claim 12, wherein the component of the blowout preventer comprises one or more of:

a control system for a sealing component of the blowout preventer, an emergency system for the blowout preventer, and a component of a hydraulic system for the blowout preventer.

21. The system of claim 12, wherein the processor is configured to execute the instructions to perform the method further comprising:

receiving, from a user, a change in the health indicator for the component of the blowout preventer; and displaying, at the graphics display, a new health indicator for the component of the blowout preventer that reflects the change received from the user.

22. A computer readable storage medium storing instructions for causing a processor to perform a method comprising:

acquiring values that correspond to operating conditions of subsystems of the well system, wherein the subsystems control and operate the blowout preventer;

evaluating a risk profile for a component of the blowout preventer based on a portion of the values that are associated with the component;

selecting a health indicator for the component of the blowout preventer based on a result of evaluating the risk profile, wherein the health indicator indicates a level of risk that the component of the blowout preventer will not provide a desired protection under current conditions; and displaying, at a graphics display, the health indicator for the component of the blowout preventer.

23. The computer readable storage medium of claim 22, the method further comprising:

evaluating a second risk profile for a second component of the blowout preventer based on a second portion of the values that are associated with the second component of the blowout preventer;

selecting a second health indicator for the second component of the blowout preventer that represents a result of evaluating the second risk profile; and simultaneously displaying, at the graphics display, the second health indicator for the second component of the blowout preventer and the health indicator for the component of the blowout preventer.

24. The computer readable storage medium of claim 22, the method further comprising:

storing the health indicator in association with a time stamp;

acquiring new values corresponding to new operating conditions of the subsystems of the well system;

evaluating the risk profile for the component of the blowout preventer based on a portion of the new values that are associated with the component of the blowout preventer;

selecting a new health indicator for the component of the blowout preventer that represents a new result of evaluating the risk profile based on the new values; and displaying, at the graphics display, a new health indicator for the component of the blowout preventer as an update to the health indicator.

25. The computer readable storage medium of claim 24, the method further comprising:

storing the new health indicator in association with a new time stamp; and displaying, at the graphics display, a history of the health indicator and the new health indicator in combination with times of the time stamp and the new time stamp.

26. The computer readable storage medium of claim 22, wherein the values comprise one or more of:

hydraulic measurements at sealing components and subsea valves of the blowout preventer; status information, flow measurements, and pressure measurements associated with a hydraulic system of the well system; electrical feedback signals; diagnostic results from control systems of the blowout preventer; mechanical positions of sealing components and subsea valves of the blowout preventer; drilling conditions at a wellbore of the well system; surface valve positions and flow paths associated with the blowout preventer; and operating information, valve position, and pressure measurements associated with a diverter system of the well system.

27. The computer readable storage medium of claim 22, wherein the displaying the health indicator comprises displaying a visual representation of the blowout preventer in which an operating condition of sealing components and control valves of the blowout preventer is indicated.

28. The computer readable storage medium of claim 22, wherein the displaying the health indicator comprises displaying a date of a functional test of the blowout preventer.

29. The computer readable storage medium of claim 22, the method further comprising:

determining, from the values, a change in an operating condition for a sealing component of the blowout preventer; and displaying, at the graphics display, the change in the operating condition of the sealing component in combination with a time of the change.

30. The computer readable storage medium of claim 22, wherein the component of the blowout preventer comprises one or more of:

a control system for a sealing component of the blowout preventer, an emergency system for the blowout preventer, and a component of a hydraulic system for the blowout preventer.

31. The computer readable storage medium of claim 22, the method further comprising:

receiving, from a user, a change in the health indicator for the component of the blowout preventer; and displaying, at the graphics display, a new health indicator for the component of the blowout preventer that reflects the change received from the user.

* * * * *